US005224849A

United States Patent [19]

Forni

[11] Patent Number: 5,224,849

[45] Date of Patent: Jul. 6, 1993

[54] COMPLIANCE MOUNTING MECHANISM FOR SCROLL FLUID DEVICE

[75] Inventor: Ronald J. Forni, Lexington, Mass.

[73] Assignee: Arthur D. Little, Inc., Cambridge, Mass.

[21] Appl. No.: 837,978

[22] Filed: Feb. 20, 1992

[51] Int. Cl.[5] ..... F01C 1/04; F01C 21/00

[52] U.S. Cl. ..... 418/55.5; 418/57

[58] Field of Search ..... 418/55.5, 57, 188

[56] References Cited

U.S. PATENT DOCUMENTS

| | | | |
|---|---|---|---|
| 4,575,318 | 3/1986 | Blain | 418/55.5 |
| 4,609,334 | 9/1986 | Muir et al. | 418/55.5 |
| 4,730,998 | 3/1988 | Kakuda et al. | 418/57 |
| 4,840,549 | 6/1989 | Morishita et al. | 418/55.5 |

*Primary Examiner*—John J. Vrablik

*Attorney, Agent, or Firm*—Bacon & Thomas

[57] ABSTRACT

A scroll fluid device includes meshing, involute scroll elements mounted for co-rotation in a support housing. One of the scroll elements is supported by a shaft extending through a bearing sleeve mounted so as to be pivotable about a pivot center located transversely of the center line of the shaft. Radial compliance movement of the shaft and bearing sleeve is also enabled about the pivot center. This enables the scroll element to pivot slightly about three independent axes to follow the movement of the opposed cooperating scroll element while at the same time providing radial compliance enabling the scroll flanks to open slightly in the event of an over pressurization between the scroll wraps. The pivot center is provided by a circular ball pivot element located between the bearing sleeve and adjacent fixed support structure.

18 Claims, 3 Drawing Sheets

COMPLIANCE MOUNTING MECHANISM FOR SCROLL FLUID DEVICE

BACKGROUND OF THE INVENTION

1. Field of the Invention

This invention pertains to a compliance mounting arrangement for a scroll fluid device that permits one scroll to move relative to a cooperating scroll and relative to a support structure to accommodate pumping disturbances or misalignment between the scrolls or between the one scroll and the support structure.

2. Background of the Prior Art

Scroll fluid devices are well known and operate on the principle of relative orbiting, intermeshing, axially, extending involute-shaped scroll flank members creating periodically and progressively closing or opening chambers during the orbiting process to thereby achieve a pumping or driving effect, depending upon the direction of fluid flow and the energy input into the system. While the scroll elements will always orbit relative to each other, in some instances both scroll elements can rotate together simultaneously with the orbital movement, such scrolls being herein referred to as "co-rotating", or one scroll can be driven in an orbital sense relative to another scroll that is held in a fixed position, the latter being referred to as non co-rotating for convenience. In either case, energy input typically will occur through a driving or drive scroll, and the other scroll will react the driving energy imparted through or resulting from the motion of the driving scroll. In some cases, both scroll elements in a co-rotating system can receive input energy and will therefore both be driven by the input energy. In some scroll fluid devices, one of the scrolls may tend to become misaligned relative to its mating scroll or its support structure due to various dynamic influences, including fluid and bearing forces acting on the scroll. This can result, for example, in a tilting of the axis of symmetry (generating axis) of one scroll relative to the other at an angle that can vary based on different operating conditions of the scroll device or a tilting of a scroll relative to its support bearing. Such relative angular orientation of the axis of a scroll element is undesirable both within the primary fluid circulation area of the scroll elements and at the bearings supporting the scroll elements. Usually, in the prior known devices, such misalignment either is held to a minimum or, is tolerated, or large oversize bearings are used to react the forces tending to cause the misalignment.

When scroll fluid devices are intended to function as liquid refrigerant compressors, it is often desired to provide radial compliance between the scroll flanks that enables the flanks to open slightly to provide relief of forces generated when a liquid slug of refrigerant is ingested by the compressor. It is therefore highly desirable to provide a mounting system for scroll elements of a scroll fluid device that will compensate for misalignment between the axes of symmetry of the scroll elements or misalignment of one scroll relative to its bearing, while at the same time providing radial compliance for the system that permits the scroll flanks to open momentary when high forces are encountered between the flanks. More specifically, it would be highly desirable to provide a compliance mounting arrangement for at least one of the scroll elements that would enable continued precise alignment between the axes of symmetry of the meshing scroll elements even though the scroll elements become slightly misaligned relative to their supporting housing or bearings while at the same time accommodating slight radial movement of one scroll relative to its mating scroll to enable the scroll flanks to open momentarily to accommodate a slug of liquid or to accommodate any other impediment to small clearances between the scroll elements.

Two types of compliance mounting arrangements useful in scroll fluid devices are described in U.S. Pat. Nos. 2,324,168 and 4,435,137, wherein pivotable link connections between the scrolls maintain scroll flank contact during normal operation, but permit radial separation of the flanks upon the occurrence of excessive forces tending to separate the flanks. Both of these patented arrangements utilize a pivot rod which interconnects the scrolls at their respective centers of rotation.

U.S. Pat. Nos. 4,730,998 and 4,846,639 disclose additional scroll fluid devices known in the art which utilize a movable bearing support in order to provide a compliance mounting. The scroll fluid device disclosed in U.S. Pat. No. 4,730,998 includes a main bearing which journals the drive shaft of the apparatus and is capable of pivoting by small angles with two degrees of freedom. In U.S. Pat. No. 4,846,639, a movable bearing supports a driven scroll in a co-rotating system so that the driven scroll is biased in the radial direction in order to minimize gaps between wrap plates associated with the drive and driven scrolls.

These known compliance mounting arrangements, while solving some alignment problems associated with scroll fluid devices and while providing radial compliance to permit scroll flanks to open upon excessive pressurization, essentially fail to resolve these problems in a single unitary compliance mounting arrangement. In addition, many known compliance mountings for compressors are unreliable due to frictional factors. For instance, a compliance mounting mechanism which is based on mutual sliding of two cooperating scrolls will lock tight when a liquid slug substantially increases the force acting on the mechanism normal to the desired sliding direction.

SUMMARY OF THE INVENTION

The present invention provides a mounting arrangement for a scroll element in a scroll fluid device that includes a pair of opposed meshing involute scroll elements arranged to create progressively and periodically varying fluid transport chambers between axially extending wrap surfaces of the scroll elements when the scroll fluid device is driven so that the axes of symmetry of the scroll elements orbit relative to each other without relative rotation between the scroll wrap surfaces, wherein the scroll mounting for one of the scroll elements includes a compliance mounting mechanism connecting the scroll element to its support so that the axis of symmetry of the scroll element can pivot relative to its support about a pivot center located transversely of the axis of symmetry of the scroll element. The pivotal movement is about three independent axes (three degrees of freedom) that effectively permits the scroll element to pivot slightly relative to its fixed support. In its preferred embodiment, the compliance mounting mechanism is associated with a support bearing for the scroll element so that the bearing of the scroll element can pivot about the pivot center with the scroll element itself.

In addition, the scroll element and its associated bearing support are mounted so that they can pivot about the pivot center in a direction that effectively translates the axis of symmetry of the scroll element transversely about the pivot center. This provides radial compliance for the scroll wraps permitting the wraps to separate under high loads.

In its preferred embodiment, the pivot center is established by a circular pivot ball element disposed between a support bearing for the scroll element and the fixed support for the scroll support bearing. The ball element provides a rolling contact point between the bearing support and the fixed support, with the rolling contact point constituting the pivot center of the compliance mounting mechanism.

In accordance with a preferred embodiment of the invention, the scroll elements are co-rotating and one of the scroll elements is supported by a bearing shaft extending in a bore within the fixed support for the scroll element. A bearing sleeve extends co-axially with the bearing shaft and the compliance mounting mechanism in the form of a pivot ball is disposed between the bearing sleeve and the bore of the fixed support. Radial compliance pivotal movement of the bearing shaft about the pivot center occurs against an adjustable spring biasing element so that the scroll wraps are normally urged towards each other but can separate away from each upon the occurrence of excessive pressure between the scroll wraps.

Accordingly, the compliance mechanism of the present invention permits a scroll element and its associated bearing to maintain alignment within desirable limits even though the scroll element may itself be misaligned with respect to the fixed supporting structure for the scroll device. Moreover, radial compliance for the scroll element is provided by the same compliance mounting mechanism due to the universal pivot movement obtained at the pivot center.

A preferred embodiment of the invention will be described below with reference to the appended drawings.

BRIEF DESCRIPTION OF THE DRAWINGS

FIG. 5 shows a force vector diagram of the bearing forces at the compliance mechanism.

DETAILED DESCRIPTION OF A PREFERRED EMBODIMENT

Although the present invention may be applied to various types of scroll fluid devices, it is depicted and described for exemplary purposes embodied in a hermetically sealed co-rotating scroll type refrigerant compressor which is adapted to be used in a closed-loop evaporator-condenser refrigeration system.

Figure 1:
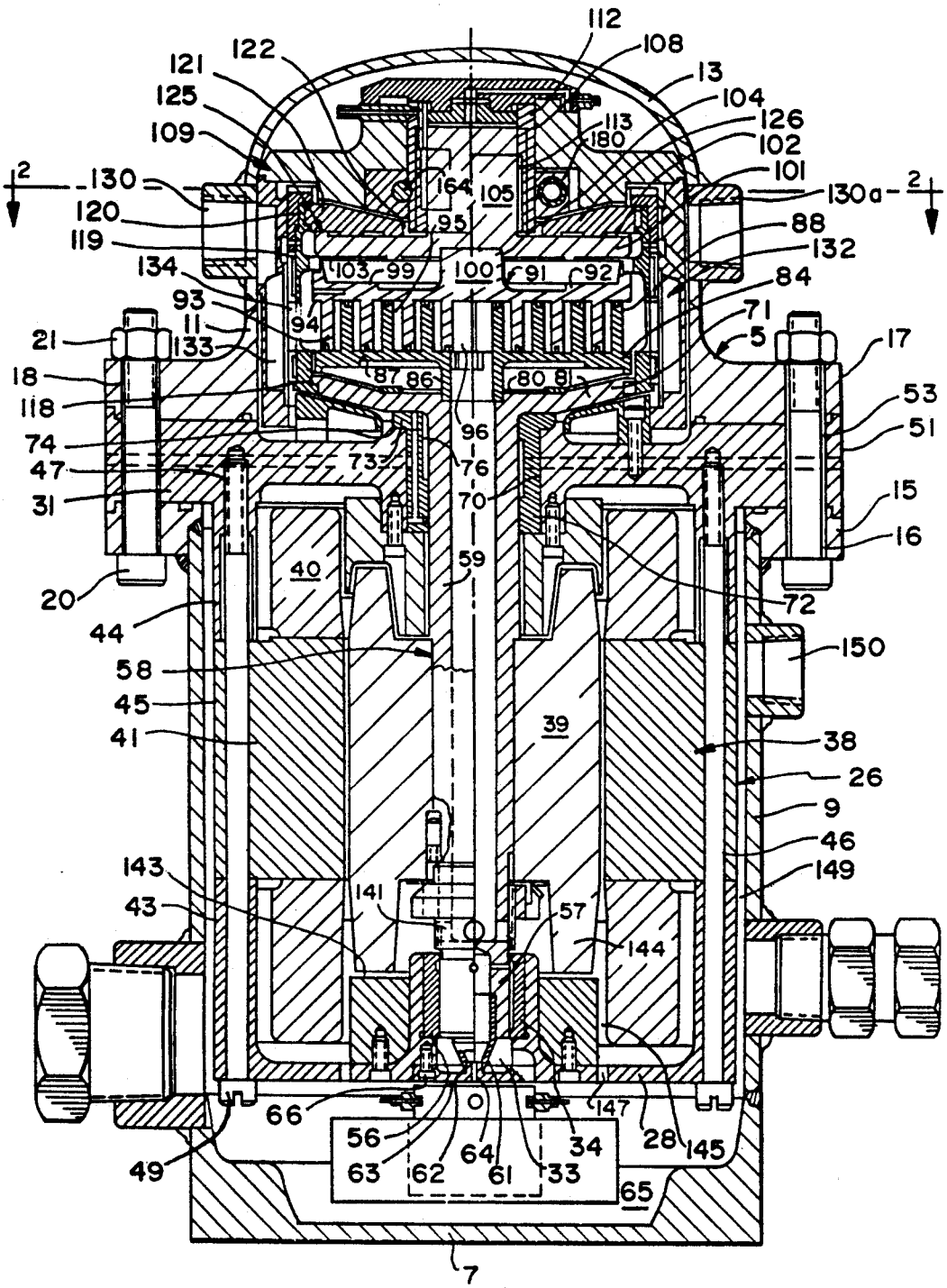
FIG. 1 is a cross-sectional elevation view of a co-rotating scroll-type refrigerant compressor incorporating a compliance mounting arrangement in accordance with of the present invention.
Figure 2:
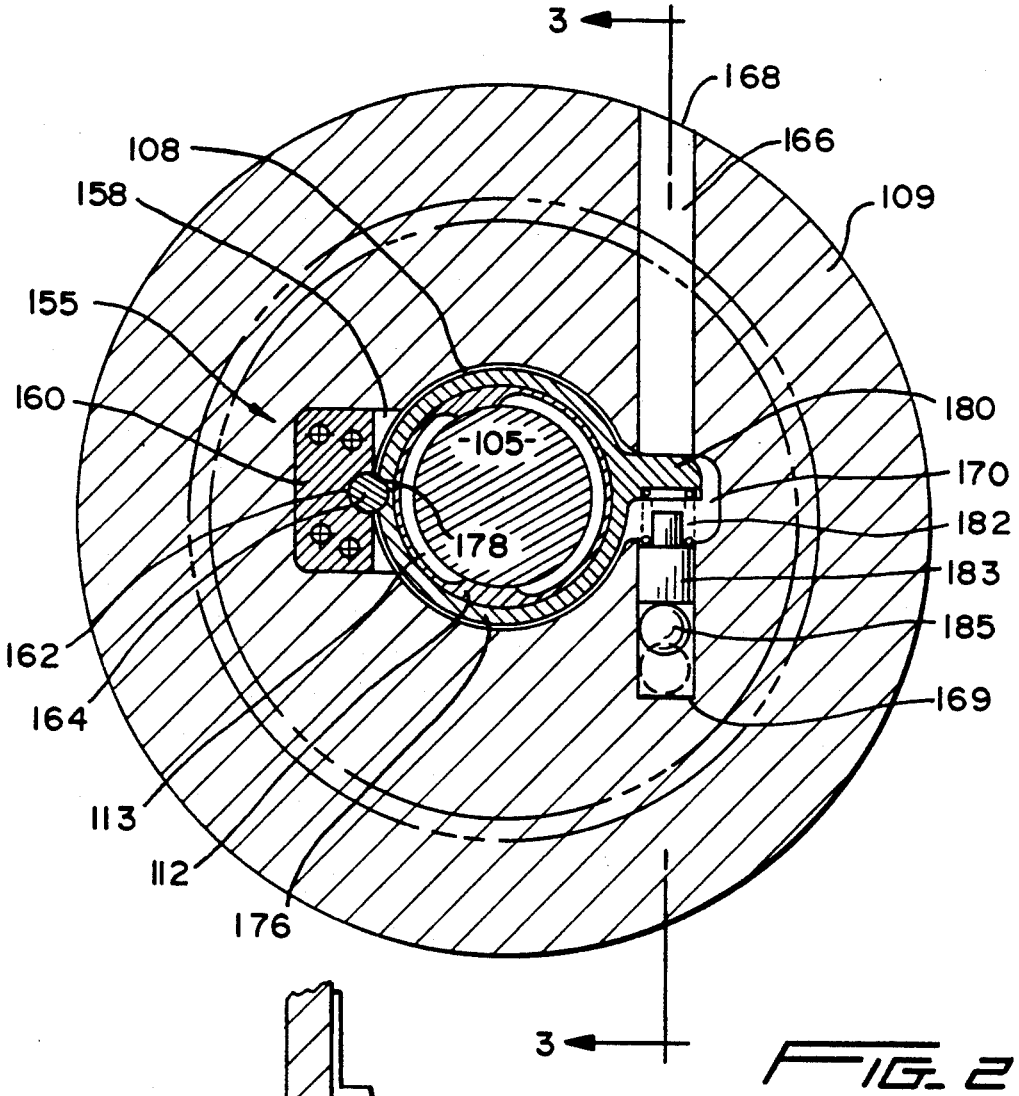
FIG. 2 is a cross-sectional view taken along line 2—2 in FIG. 1.
Figure 3:
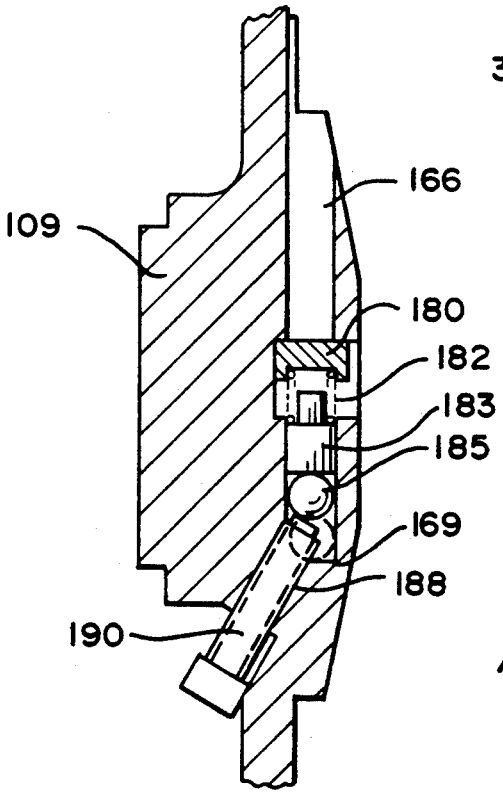
FIG. 3 is a cross-sectional view taken along line 3—3 in FIG. 2.

With initial reference to FIG. 1, a compressor is shown comprising a housing assembly 5 including a base plate 7, a lower housing section 9, an upper housing section 11 and a cover member 13. The upper end of lower housing section 9 includes a radially transversely extending annular flange 15 that is either integrally formed therewith or fixedly secured thereto by any means known in the art, such as by welding. Annular flange 15 has various circumferentially spaced apertures 16 extending substantially longitudinally therethrough. The lower end of upper housing section 11 also includes an annular flange 17 including various apertures 18 which are longitudinally aligned with apertures 16 for receiving fasteners such as bolts 20 and nuts 21 for fixedly securing upper housing section 11 to lower housing section 9 as will be more fully described herein.

Located within lower housing section 9 is a motor assembly 26. Motor assembly 26 includes a bottom plate 28 and an upper crosspiece 31. Located in bottom plate 28 is a lower central aperture 33 defined by an upstanding annular bearing flange 34. Mounted within motor assembly 26 is an electric motor 38 including a rotor 39 rotatable about a longitudinal central axis, windings 40 and a lamination section 41. The exact mounting of motor 38 will be more fully discussed hereinafter.

As depicted, motor assembly 26 includes a lower skirt section 43 integrally formed with bottom plate 28, an upper skirt section 44 formed integral with crosspiece 31 and a central skirt section 45 which is part of lamination section 41. Lower, upper and central skirt sections 43, 44, 45 include an aligned, elongated vertical aperture extending therethrough at circumferentially spaced locations. Aligned with apertures 46, in upper crosspiece 31, is an internally threaded bore 47. Motor assembly 26 is secured together by various bolts 49 which extend through apertures 46 and are internally threaded into bore 47 of upper crosspiece 31.

Upper crosspiece 31 includes an annular flange 51 which mates with annular flange 15 of lower housing section 9 and annular flange 17 of upper housing section 11. Annular flange 51 further includes a plurality of circumferentially spaced apertures 53 which can be aligned with apertures 16 and 18 formed in lower housing section 9 and upper housing section 11 respectively. Bolts 20 are then adapted to extend through aligned apertures 16, 53 and 18 and nuts 21 are secured to the bolts 20 in order to fixedly secure upper housing section 11 to lower housing section 9 with upper crosspiece 31 of motor assembly 26 therebetween. By this construction, motor assembly 26 is thereby secured within lower housing section 9.

Press-fit or otherwise secured within upstanding annular bearing flange 34 of bottom plate 28 is a lower bearing sleeve 56. Rotatably mounted within lower bearing sleeve 56 is a lower end 57 of a longitudinal extending hollow drive shaft 58. Drive shaft 58 includes an upper hollow section 59 separated by a partition from the lower end 57. Located within lower hollow end 57 is an oil cup 61 which tapers inwardly in a downward direction. Oil cup 61 is secured to drive shaft 58 and freely rotates about central knob 62 formed in an attachment plate 63. Knob 62 includes a centrally located through-hole 64 communicating between the interior of oil cup 61 and a lower sump 65 in order to permit lubricating fluid to flow into and out of oil cup 61. Attachment plate 63 is secured to bottom plate 28 by means of various bolts 66.

Upper section 59 of drive shaft 58 extends through a central opening 70 in crosspiece 31 and terminates in an integrally formed drive plate 71. Central opening 70 houses an upper bearing sleeve 72 which includes an upper transverse flange 73 embedded in a recess 74 formed in an upper surface of crosspiece 31. Upper bearing sleeve 72 includes a clearance passage 76 for the draining of lubricating fluid bearing medium. Drive plate 71 is dish-shaped and includes a substantially horizontal, central portion 80 and an upwardly sloping outer portion 81.

Located above dish-shaped drive plate 71 is a drive scroll 84 that includes a central, hollow sleeve portion 86, a wrap support plate 87 and an involute spiral wrap 88. Central, hollow sleeve portion 86 is fixedly secure to drive shaft 58 through drive plate 71. Intermeshingly engaged with drive scroll 84 is a driven scroll 91 having a wrap support plate 92 with an involute spiral wrap 93 extending downwardly from a lower first side 94. As is known in the art, defined between involute spiral wrap 88 and involute spiral wrap 93 are fluid chambers 95 that, in this example, transport and compress gaseous refrigerant radially inwardly between the scroll flanks. Typically, the scroll fluid device would operate at a high speed within a gaseous fluid medium surrounding the rotating scroll wraps so that, when the device is operated as a compressor, fluid intake occurs at the outer end of each scroll wrap and output flow through the device occurs at central output port 96. Of course, it should be understood that such scroll fluid devices can be operated as an expander by admitting pressurized fluid at port 96 and causing it to expand within the radially outwardly moving fluid chambers 95, to be discharged at the outer ends of the scroll wraps. However, for the purposes of the remainder of this description, it will be assumed that the scroll fluid device illustrated is arranged to function as a compressor.

The upper, second side 99 of wrap support plate 92 is formed with an integral central projection 100. Disposed vertically above driven scroll 91 is a pressure plate 101 having an upper side surface 102 and a lower side surface 103. Formed in lower side surface 103 is a central recess 104 into which central projection 100 of driven scroll 91 extends and is fixedly secured therein. On upper side surface 102, opposite recess 104, pressure plate 101 is formed with an axially projecting bearing support shaft 105. Bearing support shaft 105 extends into a central bore hole 108 formed in a fixed support plate 109 in upper housing section 11.

In this embodiment, drive scroll 84 and driven scroll 91 co-rotate and therefore a bearing sleeve 112 is mounted within bore 108 and extends about the periphery of bearing shaft 105. In addition, bearing sleeve 112 includes a clearance passage 113, analogous to clearance passage 76 previously discussed, for the draining of a lubricating fluid medium between bearing shaft 105 and bearing sleeve 112. It is possible, however, to fixedly secure driven scroll 91 and orbit drive scroll 84 about an orbit radius relative to scroll 91.

Extending upwardly from an outer perimeter 118 of drive plate 71 is an annular torque transmitting member 119. Secured to an upper, interior side wall 120 of torque transmitting member 119 is an annular bearing plate 121 having a central through-hole 122 therein through which bearing shaft 105 extends. An Oldham Coupling or synchronizer assembly, generally indicated at 125, is located between annular bearing plate 121 and upper side surface 102 of pressure plate 101 to maintain the drive and driven scrolls 84, 91 in fixed relationship in a rotational sense (i.e., so they cannot rotate relative to each other but maintain a fixed annular phase relationship relative to each other). Annular bearing plate 121 includes at least one clearance passage 126 for the introduction of high pressure oil to counteract the axial gas force developed and to lubricate the Oldham Coupling.

In order to drive the compressor, electric motor 38 operates in a conventional manner. Lamination section 41 is fixedly secured to upper and lower skirt sections 43,44 of housing assembly 5. Rotor 39, on the other hand, is secured to drive shaft 58 such that when motor 38 is activated, rotation of rotor 39 causes rotation of drive shaft 58, drive plate 71, drive scroll 84, annular torque transmitting member 119, annular bearing plate 121 and, in the preferred embodiment, driven scroll 91 through the Oldham synchronizer assembly 125 acting through pressure plate 101.

Formed as part of housing assembly 5, between upper housing section 11 and cover member 13, is a housing inlet port 130 which opens up into an inlet manifold 132. Inlet manifold 132 includes an inlet passage 133 leading to a scroll inlet port 134 formed in annular torque transmitting member 119, adjacent the involute spiral wraps 88 and 93. The scroll fluid intake zone is provided inside the torque transmitting member 119 around the periphery of the scrolls. Another port 130*a* may be provided optionally for instrumentation access.

When functioning as a compressor, gaseous refrigerant will enter the scroll fluid chambers 95 between spiral wraps 88, 93 through housing inlet port 130, inlet passage 133 and scroll inlet port 134. Upon activation of motor 38 and rotation of drive shaft 58, drive plate 71 and drive scroll 84, gaseous refrigerant will be pumped and compressed through the scroll device and will exit from scroll outlet port 96. Since scroll outlet port 96 opens into the hollow, upper section 59 of drive shaft 58, the compressed refrigerant will run downwardly through upper section 59. Just above lower end 57, drive shaft 58 includes a drive shaft outlet 141 which opens into motor assembly 26. Thus, refrigerant will be conducted through a passage 143 adjacent lower end 144 of rotor 39, through passage 145 adjacent windings 40 and into lower sump 65 through various outlet holes 147 formed in bottom plate 28. The refrigerant then moves along bottom plate 28, through a clearance passage 149 formed between lower housing section 9 and motor housing 26, and out through a housing outlet port 150.

Reference will now be made to FIGS. 1–4 in describing the compliance mounting mechanism 155 of the present invention. Fixed plate 109 in upper housing section 11 is formed with a first radial pocket 158. Fixedly secured within first pocket 158, by any means known in the art such as by screws, resistance welding or brazing, is a mounting insert 160. Mounting insert 160 is formed with a first spherical segment retaining socket 162 adjacent bearing receiving bore 108. Plate 109 is also formed with a transversely extending bore 166 located diametrically across from first pocket 158 on an opposite side of the bore 108. Bore 166 includes an open end 168 and a terminal end 169 located within plate 109. Intermediate terminal ends 168 and 169, plate 109 is formed with a second radial pocket 170 which is substantially located in the same transverse plane as first pocket 158.

Figure 4:
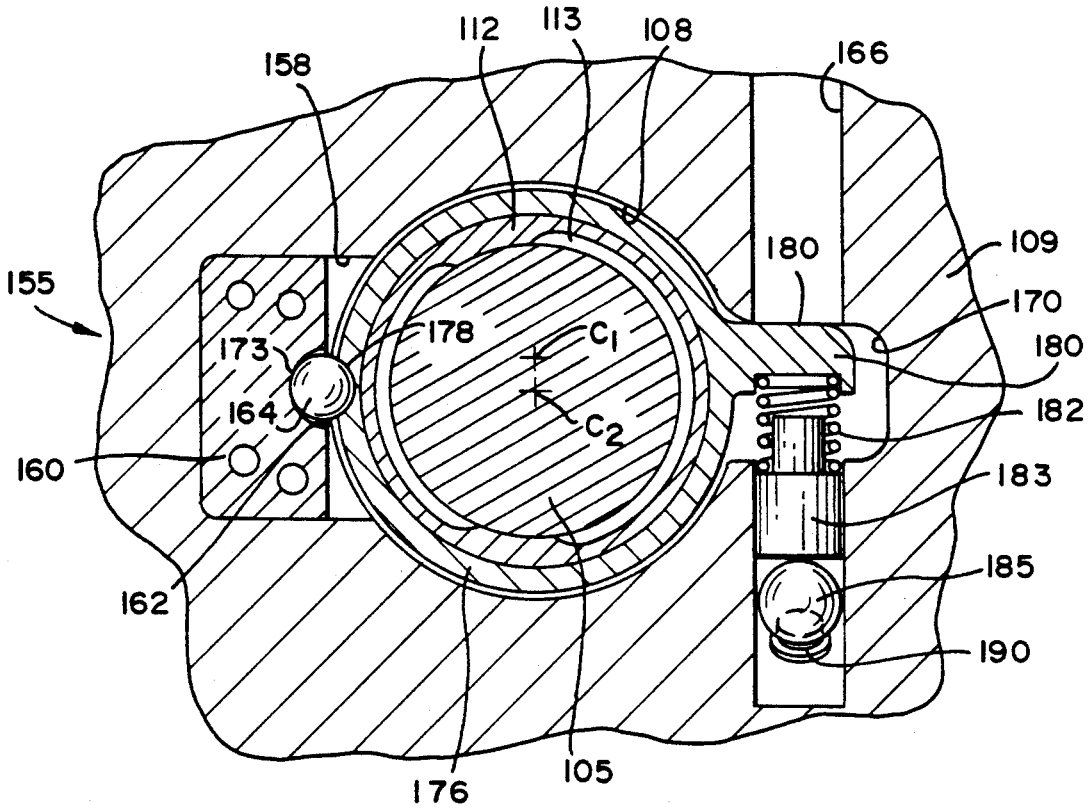
FIG. 4 is an enlarged detail of the compliance mounting mechanism according to this invention.

With references to FIG. 4, which illustrates the compliance mounting mechanism 155 in greater detail, it will be seen that the bearing support shaft 105 is mounted within a bearing sleeve 112 which in turn is mounted within a swing sleeve 176 within the bore 108 in support plate 109. However, the bore 108 is slightly larger than the swing sleeve 176 to permit slight pivoting and translation motion of the swing sleeve 176 with 3 degrees of freedom within the bore 108 in a manner that will be described in more detail below.

The swing sleeve 176 is provided with a second circular segment retaining socket 178 disposed radially opposite the first circular segment retaining socket 162. Disposed between the sockets 162 and 178 is a pivot ball 164 that is slightly smaller in diameter than the diameter of the first socket 162 and closely corresponding in diameter to the second socket 178. The swing sleeve 176 is disposed in bore 108 such that socket 178 tightly engages the pivot ball 164. The pivot ball 164 does not slide in socket 178 and contacts the mounting insert 160 at rolling contact point 173. The contact point 173 thus is a pivot center for pivotal motion of sleeve 176.

The swing sleeve 176 also includes a radially extending flange 180 disposed on side of the sleeve 176 diametrically opposite from the pivot ball 164. The flange 180 extends into a second pocket 170 of plate 109. A compression spring 182 extends between flange 180 and a spring plunger 183 mounted in a continuation of bore 166 in plate 109. A force transmitting ball element 185 is disposed beneath the plunger 183 (see FIG. 3) and is pressed against the plunger 183 by the tip of adjustment screw 190 threadingly mounted in aperture 188 in plate 109. Thus, the biasing force of compression spring 182 can be adjusted through the ball element 185 by means of the adjustment screw 190. As the screw 190 is advanced or pulled away from the ball element 185, the ball element 185 moves longitudinally within bore 166 against plunger 183 to adjust the biasing force of spring 182.

It will thus be seen that flange 180 and sleeve 176 are normally biased transversely counterclockwise as seen in FIG. 4 about the rolling contact point 173. More accurately, the sleeve 176 pivots about a center of pivotal movement that is disposed at point 173 where ball 164 contacts socket 162.

Thus, the compliance mechanism 155 provides a low friction rolling contact universal pivot center between pivot ball 164 is 0.250 inch (6.35 mm) in diameter and the socket 162 is 0.275 inch (6.985 mm) in diameter. The difference in size between the ball and the socket provides a rolling pivotal contact point between sleeve 176 and socket 162. At the same time, the pivotal mounting enables the flange 180 to move clockwise against the bias of spring 182 as viewed in FIG. 4 to separate the centers of symmetry $C_1$ and $C_2$ of the drive and driven scrolls 84 and 91, respectively. The separation of the scrolls provides radial compliance that enables the scroll wraps to separate upon encountering any influence that creates excessive force between the scroll wraps. The spring 182 biases the wraps of scroll 91 towards the wraps of scroll 84.

Figure 5:
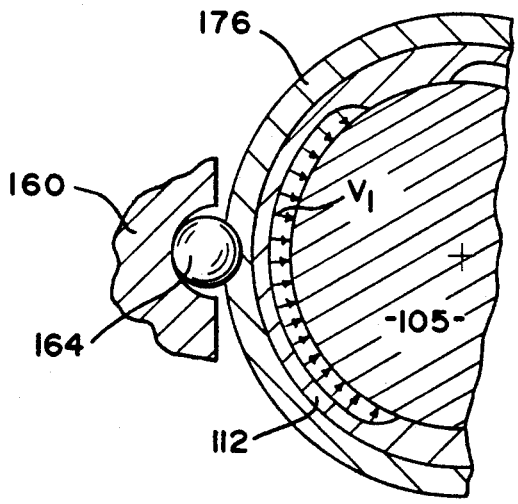
FIG. 5 shows an enlarged detail of a portion of the compliance mounting mechanism of FIGS. 2 and 4 indicating a force vector diagram of the bearing forces at the compliance mechanism.

In accordance with the present invention, the pivot ball 164 is located at a center of pressure generated between shaft 105 and bearing sleeve 112. As illustrated in FIG. 5, force vectors $V_1$ represent reaction forces between the shaft 105 and the bearing pads of bearing sleeve 112. The bearing pads of the bearing sleeve 112 are located so as to properly react loads imposed on the driven scroll 91 during operation of the scroll system. It will be noted that the ball element 164 is disposed at the center of pressure (radial) so that instabilities are not introduced during operation of the scroll device.

With reference to FIG. 1, it will be observed that the compliance mechanism 155 is disposed transversely of the center line of bearing shaft 105 and transversely of the axis of symmetry of the driven scroll 91. Such location enables the compliance mechanism 155 to provide a pivot center for the entire rotating mechanism associated with scroll 91. The annular bearing plate 121 reacts axial thrust loads tending to axially separate the drive and driven scrolls through annular torque transmitting member 119. Since bearing shaft 105 can move axially within bearing sleeve 112, the axial position of driven scroll 91 is controlled by annular bearing plate 121 by its connection to drive plate 71 through annular torque transmitting member 119. Essentially, the compliance mechanism 155 permits the driven scroll 91 and its bearing sleeve to pivot about three independent axes (to have 3 degrees of freedom) to follow any misalignment of the axis of symmetry (i.e. axis of rotation) of the driven scroll 91 relative to the upper housing 11 and plate 109 secured to the upper housing. At the same time, radial compliance is provided by locating the compliance mechanism 155 to one side of the axis of symmetry of the driven scroll 91 so that, as explained previously, the scroll wraps may separate upon encountering excessive pressure between the scroll wraps.

The three independent axes intersect at the point of rolling contact between the ball 164 and the socket 173 and insert 160. The first axis extends parallel to the axis of symmetry (i.e. axis of rotation) of the driven scroll 91; the second axis extends perpendicular to and intersects the axis of symmetry of the scroll 91; and the third axis extends perpendicular to the axis of symmetry of the driven scroll 91 but does not intersect this axis of symmetry, preferably extending perpendicular to the second axis.

A specific preferred embodiment of the invention has been described, but it should be understood that variations of the mechanism can be made by persons skilled in the art without departing from the spirit and scope of the invention which is defined in the appended claims.

I claim:

1. In a scroll fluid device including a pair of opposed meshing involute scroll elements arranged to create progressively and periodically varying fluid transport chambers between axially extending wrap surfaces of the scroll elements when the scroll fluid device is driven so that the axes of symmetry of the scroll elements orbit relative to each other without relative rotation between the scroll wrap surfaces, the improvement comprising:

a fixed support for one of the scroll elements;

a compliance mounting mechanism connecting said one scroll element to said support;

said compliance mounting mechanism comprising means for enabling the axis of symmetry of said one scroll element to pivot relative to said support about three independent axes intersecting a pivot center located transversely of said axis of symmetry.

2. The improvement in a scroll fluid device as claimed in claim 1, including a bearing support for said one scroll element and wherein said compliance mounting mechanism comprises a spherical bearing surface connected to the bearing support and disposed between the bearing support and the fixed support, said spherical bearing surface contacting the fixed support at a point of rolling contact on the spherical bearing surface, said point of rolling contact constituting said pivot center.

3. The improvement in a scroll fluid device as claimed in claim 2, wherein said spherical bearing surface comprises a pivot ball element, said ball element contacting the fixed support at said rolling contact point.

4. The improvement in a scroll fluid device as claimed in claim 3, said pivot ball element having a ball diameter, said fixed support and said bearing support including opposed spherical sockets, at least one of said sockets having a diameter larger than said ball diameter, said pivot ball element disposed between and engaging said spherical sockets.

5. The improvement in a scroll fluid device as claimed in claim 2, wherein in said one scroll element includes a bearing shaft extending axially along the axis of symmetry of said one scroll element, said pivot center disposed at a location radially spaced from said axis of symmetry of said one scroll element and axially spaced from the wrap of said one scroll element.

6. The improvement in a scroll fluid device as claimed in claim 1, said compliance mounting mechanism comprising means for enabling the axis of symmetry of said one scroll element to move substantially transversely relative to said fixed support and relative to an axis of symmetry of an opposed scroll element about said pivot center in a direction to cause separation of the involute wraps of the scroll elements.

7. The improvement in a scroll fluid device as claimed in claim 6, comprising biasing means for urging said scroll wraps in a direction towards each other.

8. The improvement in a scroll fluid device as claimed in claim 7, comprising means for adjusting the force exerted by said biasing means.

9. The improvement in a scroll fluid device as claimed in claim 5, said bearing support comprising bearing sleeve means for supporting said bearing shaft relative to said fixed support, said bearing shaft extending through said bearing sleeve means, rotation of said bearing shaft within said bearing sleeve means generating pressure forces, said pivot center being disposed along the center of pressure.

10. The improvement in a scroll fluid device as claimed in claim 1, wherein said scrolls are mounted for co-rotation relative to each other and relative to said fixed support, said one of the scroll elements including a bearing shaft extending along the axis of symmetry of said one scroll element;

said fixed support including a bore for receiving said bearing shaft;

said pivot center disposed at a location radially spaced from said axis of symmetry of said one scroll element and axially spaced from the involute wrap of said one scroll element.

11. The improvement in a scroll fluid device as claimed in claim 10, where in said pivot center is located at a position spaced radially from said bearing shaft.

12. The improvement in a scroll fluid device as claimed in claim 10, said compliance mounting mechanism comprising means for enabling said bearing shaft to move substantially transversely about said pivot center relative to said bore in a direction along a radial line connecting the axes of symmetry of said scroll elements; and means resiliently urging said bearing shaft in a direction tending to close the space between the wraps of the scroll elements.

13. The improvement in a scroll fluid device as claimed in claim 10, including a bearing support for rotatably supporting said bearing shaft relative to said fixed support in said bore; said bearing support comprising a bearing sleeve co-axially extending along the external diameter of the bearing shaft between the bearing shaft and the bore, said bearing sleeve including an outer circumferential periphery; a first spherical segment socket formed in said bearing sleeve periphery; said bore being larger than the outer diameter of said sleeve, said fixed support including a second spherical segment socket disposed radially opposite said first socket; a pivot ball element bridging said sockets; the point of contact between said ball and said second socket constituting said pivot center.

14. The improvement in a scroll fluid device as claimed in claim 13, including means for enabling translation of said bearing shaft and said bearing sleeve transversely in an arc about said pivot center to provide radial compliance for the cooperating scroll wraps.

15. The improvement in a scroll fluid device as claimed in claim 14, including means for resiliently urging said bearing shaft and bearing sleeve in a direction about said pivot center tending to bring the scroll wraps together.

16. The improvement in a scroll fluid device as claimed in claim 15, including means for adjusting the force exerted by said means for resiliently urging the bearing shaft and bearing sleeve about said pivot center.

17. The improvement in a scroll fluid device as claimed in claim 15, said means for resiliently urging said bearing shaft and bearing sleeve in a direction about said pivot center including means engaging the bearing sleeve at a location diametrically opposite said first socket.

18. The improvement in a scroll fluid device as claimed in claim 1, wherein one of said independent axes extends parallel to the axis of symmetry of said one scroll element; another of said independent axes extends perpendicular to the axis of symmetry of said one scroll element and intersects said axis of symmetry; and the other of said independent axes extends perpendicular to said axis of symmetry of said one scroll element but does not intersect said axis of symmetry.

* * * * *